United States Patent [19]

White et al.

[11] Patent Number: 4,669,916

[45] Date of Patent: Jun. 2, 1987

[54] UNITIZED TLP ANCHOR TEMPLATE WITH ELEVATED WELL TEMPLATE

[75] Inventors: Charles N. White; Andrew F. Hunter, both of Houston, Tex.

[73] Assignee: Conoco Inc., Ponca City, Okla.

[21] Appl. No.: 840,235

[22] Filed: Mar. 17, 1986

[51] Int. Cl.[4] ..... E02B 17/00

[52] U.S. Cl. ..... 405/224; 166/367; 405/195

[58] Field of Search ..... 405/224, 203, 204; 166/350, 359, 367; 175/7

[56] References Cited

U.S. PATENT DOCUMENTS

| | | | |
|---|---|---|---|
| 3,086,368 | 4/1963 | Popper | 405/224 |
| 3,396,544 | 11/1966 | Manning . | |
| 3,976,021 | 8/1976 | Blenkarn et al. . | |
| 3,996,755 | 12/1976 | Kalinowski | 405/224 X |
| 4,169,424 | 10/1979 | Newby et al. | 405/224 X |
| 4,194,568 | 3/1980 | Buresi et al. | 166/367 X |
| 4,591,295 | 5/1986 | Collipp | 405/195 |

*Primary Examiner*—Dennis L. Taylor
*Attorney, Agent, or Firm*—Stephen A. Littlefield

[57] ABSTRACT

In a Tension Leg Platform, the common practice is to locate the well and anchor templates on the sea floor. This practice results in unequal lengths for the mooring elements which extend to the base of the floating structure and the well risers which extend to a well deck level which is elevated above the base of the floating structure. As a consequence, complicated tensioning systems having an extremely long stroke may be required for the well risers. The present invention provides for a well template which is elevated above the anchor templates at a level which equalizes the lengths of the mooring elements and the well risers. The well and anchor templates are constructed in a unitary structure to facilitate installation and assure proper spacing of the templates with respect to each other. In preferred embodiments of the invention, subsea storage is provided as well as curved conductors which facilitate angular deviation of the wellbores away from the template and J-tubes for the pull-in of subsea flowlines.

6 Claims, 5 Drawing Figures

UNITIZED TLP ANCHOR TEMPLATE WITH ELEVATED WELL TEMPLATE

This invention relates to the art of offshore hydrocarbon production and, more particularly, to an improved subsea well and anchoring system for a tension leg platform (TLP).

BACKGROUND OF THE INVENTION

With the gradual depletion of subterranean and shallow subsea hydrocarbon reservoirs, the search for additional petroleum reserves is being extended to deeper and deeper waters on the outer continental shelves of the world. As such deeper reservoirs are discovered, increasingly complex and sophisticated production systems have been developed. It is projected that in the near future, offshore exploration and production facilities will be required for probing depths of 10,000 feet or more. Since bottom founded structures are generally limited to water depths of no more than about 1,500–2,000 feet because of the shear size of structure required, other, so-called compliant structures have been developed.

One type of compliant structure receiving considerable attention is a tension leg platform (TLP). A TLP comprises a semisubmersible-type floating platform anchored to the sea bed through vertical members or mooring lines called tension legs. The tension legs are maintained in tension at all times by insuring that the buoyancy of the TLP exceeds its operating weight under all environmental conditions. A TLP is compliantly restrained in the lateral directions allowing sway, surge and yaw while vertical plane movements such as heave, pitch and roll are stiffly restrained by the tension legs.

In the first commercially installed TLP built for the Hutton Field in the U.K. North Sea, installed in 485 feet of water, separate piled anchor templates were provided for anchoring the tensioned mooring elements extending from each of the four corner columns of the floating tension leg platform. A separate well template was also provided on the sea bed. Precise location of the four anchor templates and the well template with respect to each other was essential despite the fact that installation involved five separate operations to locate each individual template on the sea floor. In a deeper water installation, such a procedure involving five separate precision template locating operations would involve such a high cost as to be uneconomic if not totally impossible.

Riser elements extending from a subsea template to the well heads located on a deck of the floating platform present a problem during lateral offset of the platform. Because the riser elements are longer than the mooring elements, tensioning devices of relatively long stroke must be provided to avoid riser buckling during such lateral offset.

In drilling to penetrate subterranean oil deposits, particularly from a centralized offshore platform, it is often desirable to deviate a borehole outwardly away from the subsea template located directly under the platform. A fixed, bottom founded platform structure offers the availability of the use of curved conductors above the sea floor to give an initial angular offset in drilling deviated holes. However, a bottom founded template generally does not permit the building of angle from the vertical until a point subsequent to subterranean penetration.

A still further difficulty associated with the use of a TLP, particularly in deep water, is the storage of produced hydrocarbons. Deck storage of large amounts of produced hydrocarbons is impossible due to space and size limitations. Sales pipeline transfer of produced fluids is possible but may be uneconomic in a remote deep water installation. This is also true of a moored tanker storage facility in the vicinity of a TLP.

A TLP, as generally conceived, does not provide an adequately solid foundation for pulling in and attaching subsea flow lines through a J-tube for production sales or connection of satellite subsea wells.

SUMMARY OF THE INVENTION

The present invention provides an integrated template for the installation of a TLP which overcomes the problems of anchor installation, complicated riser tensioning, and, optionally, wellbore deviatation, produced fluid storage and pull-in of subsea flowlines and pipelines through a J-tube.

In accordance with the invention, a tension leg platform comprises a floating structure having a wellhead deck located at a first level on the platform. The platform is tethered to the sea floor by a plurality of subsea anchor templates and a plurality of generally vertically oriented, parallel, tensioned mooring elements extending from the anchor templates to a tether connection level on the platform. The tether connection level is located at a distance $d_1$ below the wellhead deck on the platform. Riser elements extend from a subsea well template located within the array of anchor templates to the wellhead deck. The anchor templates and well template comprise a unitary structure having an anchor level on which the plurality of anchor templates are located and the well template is located at a level which is elevated by a distance $d_2$ vertically above the anchor level. The distance $d_2$ is substantially equal to the distance $d_1$ thereby substantially equalizing the length of the mooring elements and the risers.

Further in accordance with the invention, subsea storage tanks are provided as part of the unitary structure of the anchor and well templates as described above.

Still further in accordance with the invention, a plurality of curved well conductors extend to the sea floor from the elevated well template described previously.

Still further in accordance with the invention, the unitary structure including the anchor and well templates and subsea storage as described above comprise a unitary reinforced concrete structure located on the sea floor.

Still further in accordance with the invention, the unitary structure of anchor and well templates as described above further includes one or more J-tubes attached to the structure for pulling in subsea flowlines and pipelines.

It is therefore an object of this invention to provide a means for positively locating TLP anchor and well templates with respect to each other in a unitary structure which allows well riser elements to have a length extending between the well template and the platform which is substantially equal to the length of the mooring elements which extend between the anchor templates and the platform.

It is a further object of this invention to provide a means for subsea storage of produced hydrocarbons for a tension leg platform.

It is yet another object of this invention to provide a means for building angular deviation into the drilling of subterranean formations from a tension leg platform prior to passage of a drill bit into the sea floor.

It is a further object of this invention to provide a means for connecting subsea flowlines and pipelines through a subsea template to a TLP.

BRIEF DESCRIPTION OF THE DRAWINGS

These and other objects of the invention are accomplished through the manner and form of the present invention as will be hereinafter described in conjunction with the accompaning drawings forming a part of this specification and in which.

DETAILED DESCRIPTION OF THE PREFERRED EMBODIMENTS AND THE DRAWINGS

The invention will now be described in the more limited aspects of a preferred embodiment thereof. It will be understood that the description of a preferred embodiment is presented for the purposes of illustrating the concepts of the invention only and should not be considered as a limitation upon the scope of the invention.

Figure 1:
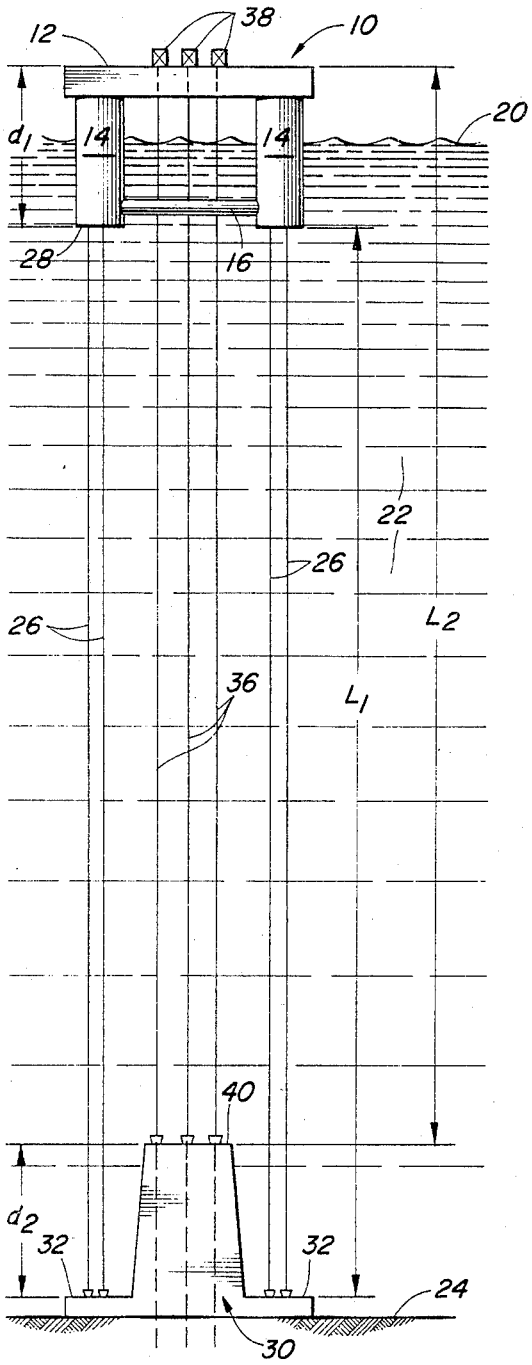
FIGS. 1 and 2 are simplified schematic views of a tension leg platform installation illustrating the general concepts of this invention.

Referring now to the drawings, FIG. 1 shows a simplified tension leg platform 10 having a wellhead deck 12 and a number of vertically oriented, generally cylindrical corner columns 14. In a typical tension leg platform structure, the corner columns 14 are interconnected by horizontal pontoon members 16.

The tension leg platform 10 is floating on the surface 20 of a body of water 22. The tension leg platform 10 is anchored to the sea floor 24 by a plurality of tensioned mooring elements 26 extending or at least pivoted from the base 28 of the corner columns 14 to a unitary anchor base 30 located on the sea floor 24. The unitary anchor base 30 includes a number of mooring anchor templates 32 which serve as the connectors for the tensioned mooring elements 26 to the unitary anchor base 30. The number of anchor templates 32 corresponds to the number of corner columns 14 from which the tensioned mooring elements 26 extend. Thus, the tensioned mooring elements 26 have a length $L_1$ extending from between the base 28 of the corner columns 14 and the corresponding anchor template 32. In accordance with the principles of a tension leg platform, the mooring elements 26 are maintained in constant tension by assuring that the buoyancy of the tension leg platform 10 is always in excess of its operating weight under all environmental conditions. Thus, the length $L_1$ of the tensioned mooring elements 26 is substantially constant (there is some inherent elasticity in the elements themselves) at all times.

A plurality of well risers 36 extend from the well deck 12 to the unitary anchor base 30. The well deck 12 is located a distance $d_1$ above the base 28 of the corner columns 14. Each of the well risers 36 terminates in a wellhead apparatus 38 commonly referred to as a Christmas tree located on the wellhead deck 12. The wellhead apparatus 38 is commonly connected to the wellhead deck 12 through a complicated tensioner system which maintains the well risers 36 in constant tension. The well risers 36 extend to a well template 40 located on the unitary anchor base 30. In accordance with the invention, the well template 40 is located on the unitary anchor base 30 in an elevated position. The well template 40 is located a distance $d_2$ above the plane of the anchor templates 32 and, the distance $d_2$ is substantially equal to the distance $d_1$ described previously. Thus, in accordance with the invention, the well risers 36 have a length $L_2$ which is substantially equal to the length $L_1$ of the mooring elements 26.

Figure 2:
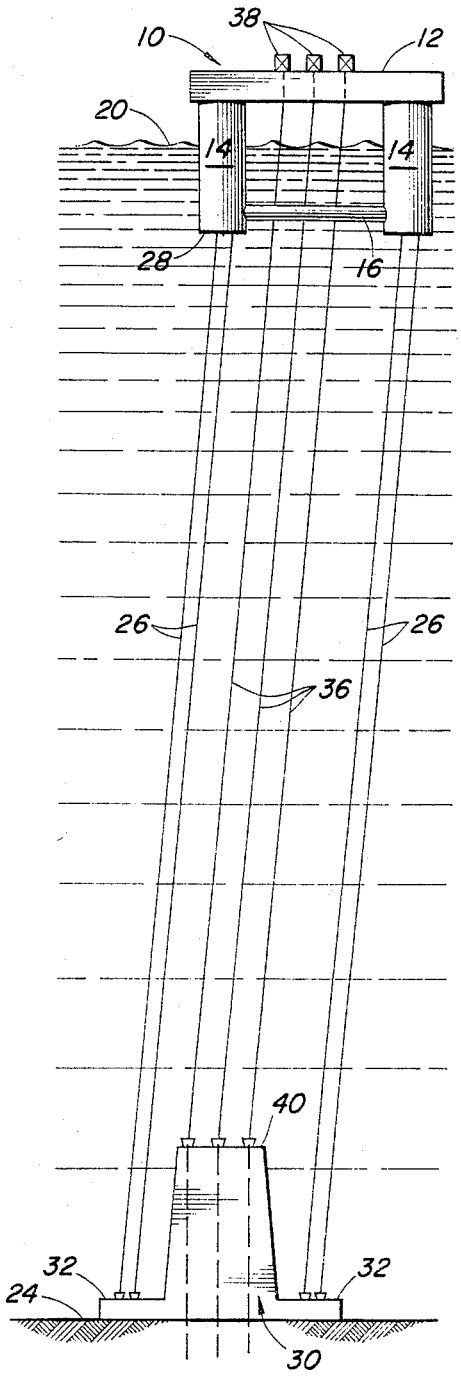

A comparison of FIGS. 1 and 2 illustrates the advantages afforded by the present invention in equalizing the lengths of $L_1$ and $L_2$ of the mooring elements 26 and the well risers 36, respectively. In the steady state of the moored TLP as shown in FIG. 1, substantially no motion compensation is required for the wellhead apparatus 38 at the top of the well risers 36. However, during platform offset such as may be caused by winds, waves and/or current, as shown in FIG. 2, the present invention minimizes the need for a substantial stroke in riser tensioning apparatus because of the equal length of the risers 36 and the mooring elements 26. In a common subsea installation, the well template 40 would be located on the sea floor 24 and the well risers 36 would extend to the well template 40. In this manner, the well risers 36 would be substantially longer than the mooring elements 26 and, with platform offset as illustrated in FIG. 2, a substantial stroke in the wellhead tensioning apparatus 38 would be required to compensate for the substantial length difference between the well risers 36 and the mooring elements 26 due to the parallel offset of these elements.

Figure 3:
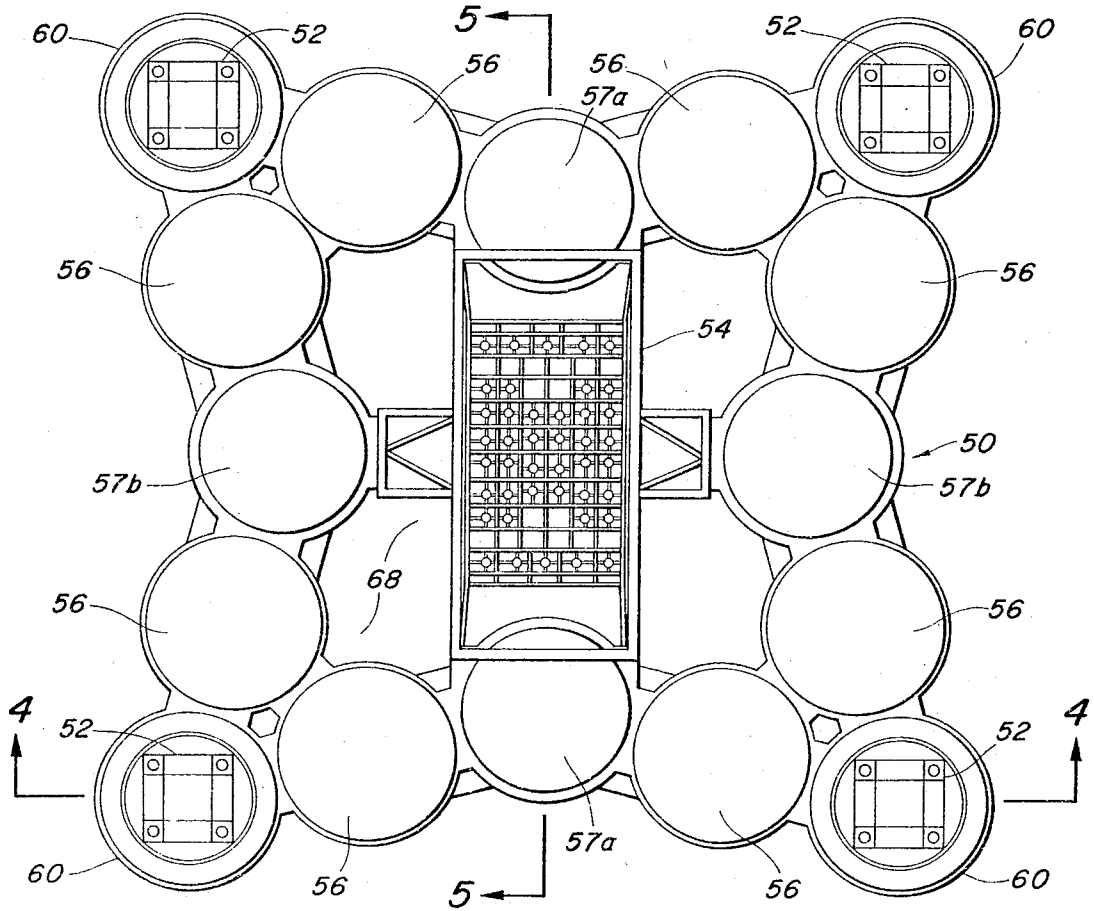
FIG. 3 is a top, plan view of a preferred form of the unitary integrated template in accordance with the present invention.
Figure 4:
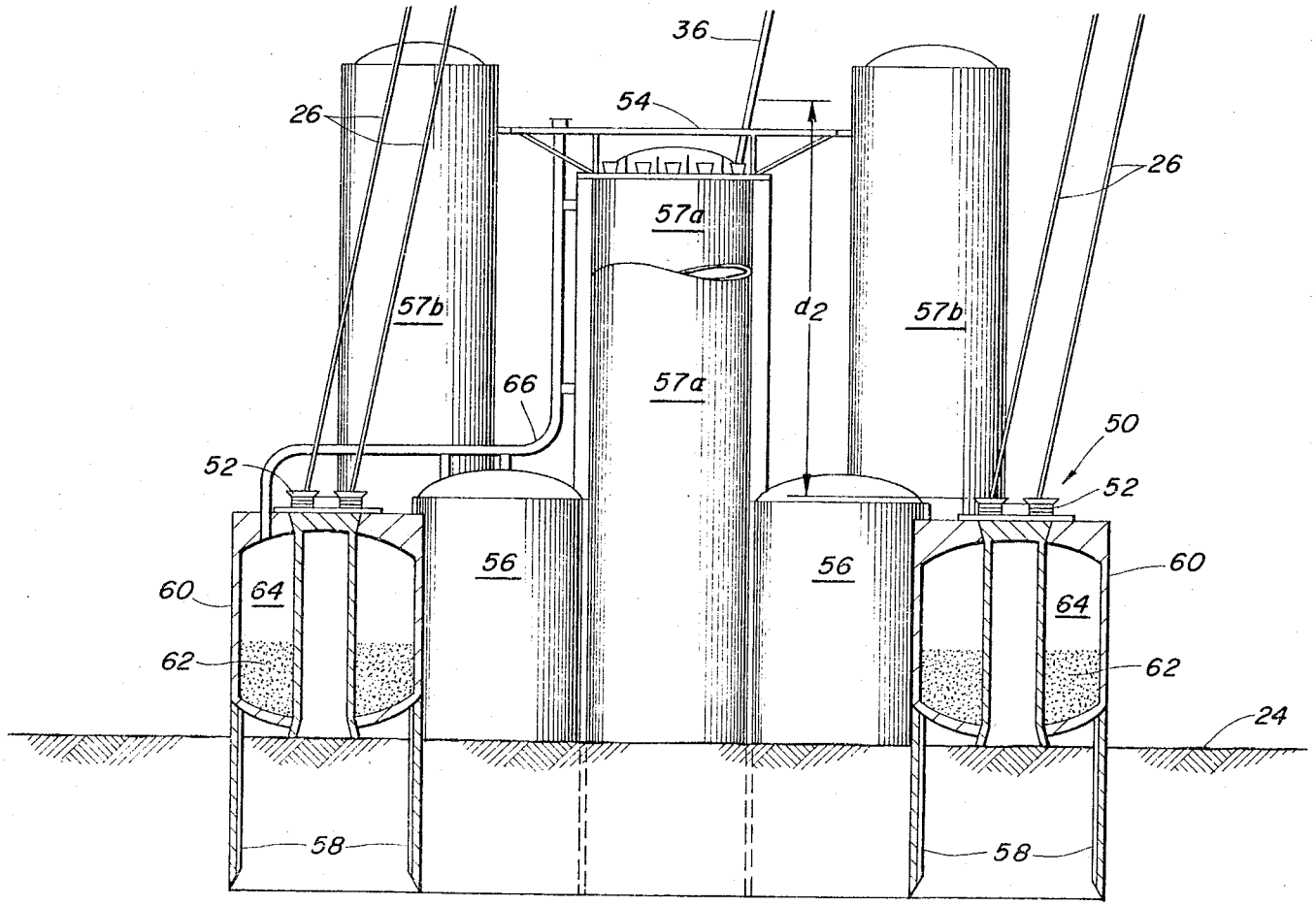
FIG. 4 is a side elevational view in partial section of the unitary integrated template shown in FIG. 3 taken along line 4—4 thereof.
Figure 5:
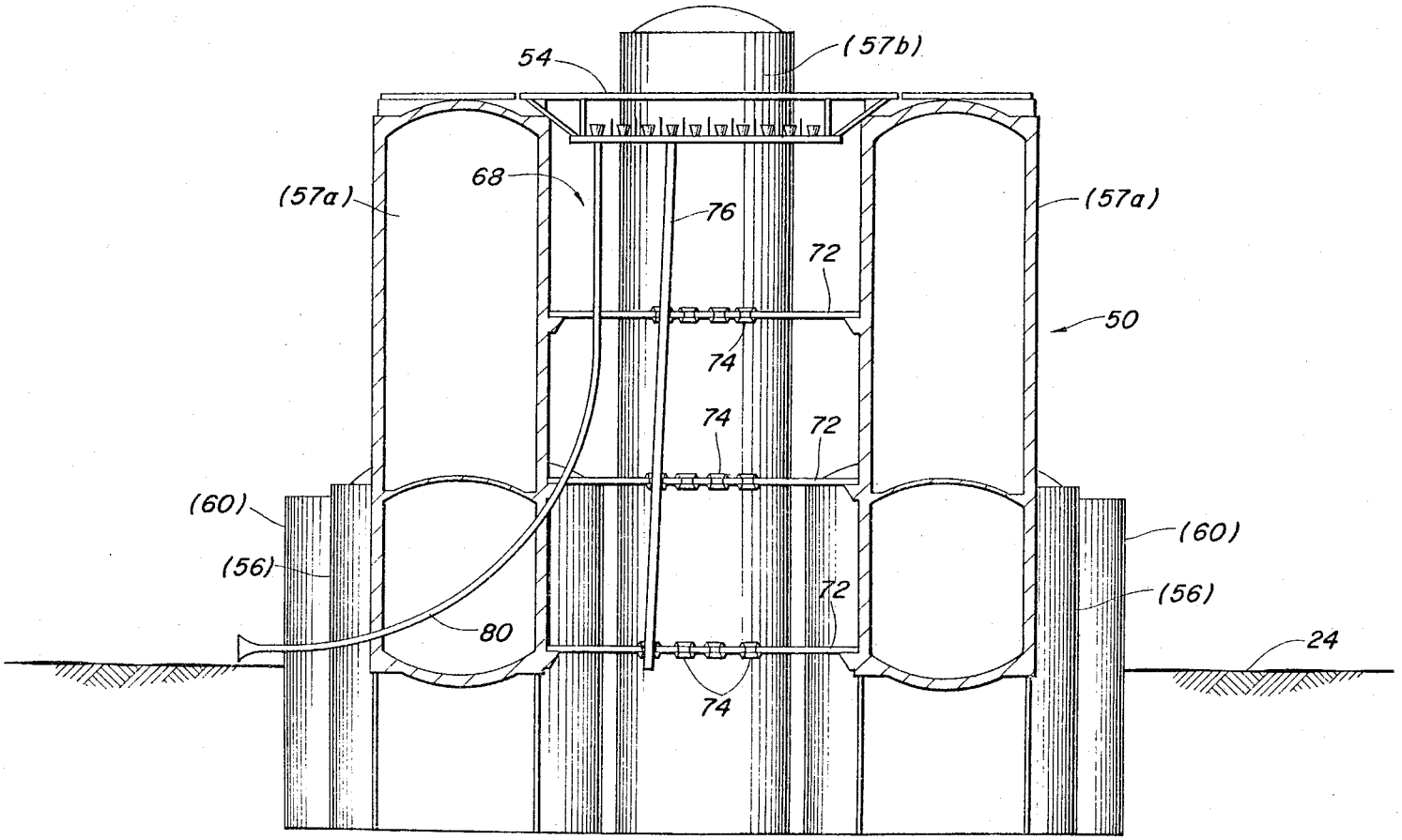
FIG. 5 is a side elevational, cross-sectional view of the unitary integrated template shown in FIG. 3 taken along line 5—5 thereof.

FIGS. 3–5 illustrate a preferred embodiment of a unitary well anchor template in accordance with this invention which have been more generally described with regard to FIGS. 1 and 2 and the unitary anchor base 30. In its preferred form as shown in FIGS. 3–5, a unitary gravity base well and anchor template 50 is shown. Anchor templates 52 are located at each of the four corners of the unitary gravity base template 50. It will be understood that while a four-cornered unitary template 50 is shown, a triangular, pentagonal, hexagonal or other polygonal structure may be provided corresponding to the polygonal shape of the floating tension leg platform which is moored to the unitary gravity base template. Similarly, although a four-cornered square configuration is shown, it may be desirable to have a four cornered rectangular form to the tension leg platform and the unitary gravity base template.

In accordance with the invention, the well template 54 is generally centrally located within the unitary gravity base template 50 at an elevated position with respect to the plane defined by the anchor templates 52. As stated previously, the elevation of the well template 54 above the plane of the anchor templates 52 substantially corresponds to the distance between the base of the corner columns of the floating platform structure and the level of the wellhead deck. In its preferred form, the means for mounting the well template 54 includes means for leveling the well template. Thus, the level installation of the unitary gravity base template as a whole becomes less critical.

In accordance with another aspect of the present invention, the unitary gravity base template 50 further includes an array of vertically oriented cylindrical storage tanks 56. The storage tanks 56 are interconnected to form a part of the framework which interconnects the anchor templates 52 and the tanks 57*a*, 57*b* which serve as the support mounting structure for the well template 54. In the preferred embodiment of the invention, the major construction material for the tanks 56 and, for that matter, the entirety of the unitary gravity base template 50 is reinforced concrete. While other construction materials may be used and are contemplated within the scope of this invention, reinforced concrete offers economy of construction materials as well as decreased weight to be handled in the installation process. Furthermore, the compressive strength of reinforced concrete is extremely advantageous in a deep water environment.

As best shown in FIG. 4, a plurality of skirt pile structures 58 extend into the earth below the sea floor 24. This method of installation is particularly useful in clayey soils or other unconsolidated subsea basins. Also as shown in FIG. 4, the corner structures 60 which support the anchor templates 52 may comprise hollow cylinders which include solid ballast materials 62 and a water chamber 64. Various common of valving and controls can be used to flood the water chambers 64 and the various storage tanks 56 in order to ballast the unitary template structure 50 for installation on the sea floor 24. A plurality storage tank service conduits 66 may be provided for this purpose.

A particular advantage afforded by the elevated positioning of the well template 54 beyond the previously described equalization of length between the mooring elements and the well risers is shown in FIG. 5. In the open interior space 68 within the array of storage tanks 56 and below the well template 54, a plurality of connductor guidance frames 72 may be provided having a plurality of connductor guide funnels 74. The conductor guidance frames 72 and their guide funnels 74 permit the use of a curved conductor 76 extending from the well template 54 to the sea floor 24 thereby permitting entry of a drill string into the sea floor 24 at an angle of less than 90°, which facilitates the early building of angular deviation for the wellbore.

FIG. 5 also illustrates the attachment of a J-tube 80 onto the unitary gravity base template 50. The J-tube permits the pull in of subsea flowlines and pipelines to the TLP structure.

While the invention has been described in the more limited aspects of a preferred embodiment thereof, other embodiments have been suggested and still others will occur to those skilled in the art upon a reading and understanding of the foregoing specification. It is intended that all such embodiments be included within the scope of this invention as limited only by the appended claims.

Having thus described our invention, we claim:

1. In a tension leg platform wherein a floating structure having a wellhead deck located at a first level on said platform is tethered to a sea floor by a plurality of subsea anchor templates and a plurality of generally vertically oriented, parallel, tensioned mooring elements extending from said anchor template to a tether connection level located a distance $d_1$ below said first level on said platform and riser elements extending from a subsea well template to said wellhead deck, the improvement which comprises a unitary structure having an anchor level on which said plurality of anchor templates are located and an elevated well template located at a distance $d_2$ vertically above said anchor level and wherein $d_2$ is substantially equal to $d_1$ whereby said mooring elements and said riser elements each have a length and the length of a mooring element is substantially equal to the length of a riser element.

2. The improvement as set forth in claim 1 wherein said unitary structure comprises a reinforced concrete structure.

3. The improvement as setforth in claim 1 further including subsea storage tanks attached to said unitary structure.

4. The improvement as setforth in claim 3 wherein said unitary structure including said, storage tanks comprise a reinforced concrete structure.

5. The improvement as setforth in claim 1 further including curved well conductors extending from said elevated well template to the sea floor.

6. The improvement as set forth in claim 1 further including J-tube means for pull-in of subsea flowlines.

* * * * *